United States Patent [19]

Hutchings

[11] 4,139,453

[45] Feb. 13, 1979

[54] HYDROREFINING AN ASPHALTENE-CONTAINING BLACK OIL WITH UNSUPPORTED VANADIUM CATALYST

[75] Inventor: Le Roi E. Hutchings, Mt. Prospect, Ill.

[73] Assignee: UOP Inc., Des Plaines, Ill.

[21] Appl. No.: 912,706

[22] Filed: Jun. 5, 1978

[51] Int. Cl.[2] ..... C10G 23/02

[52] U.S. Cl. ..... 208/213; 208/254 H

[58] Field of Search ..... 208/213, 215, 209, 254 H, 208/216

[56] References Cited

U.S. PATENT DOCUMENTS

| | | | |
|---|---|---|---|
| 3,282,828 | 11/1966 | Gleim | 208/254 H |
| 3,293,172 | 12/1966 | Gleim | 208/254 H |
| 3,471,398 | 10/1969 | Borst, Jr. | 208/209 |
| 3,558,474 | 1/1971 | Gleim et al. | 208/213 |
| 3,622,497 | 11/1971 | Gleim | 208/215 |
| 3,657,111 | 4/1972 | Gleim | 208/213 |
| 3,720,602 | 3/1973 | Riley et al. | 208/216 |
| 3,992,285 | 11/1976 | Hutchings | 208/213 |

*Primary Examiner*—George Crasanakis

*Attorney, Agent, or Firm*—James R. Hoatson, Jr.; Cutts, Jr. John G.; William H. Page II

[57] ABSTRACT

Desulfurization and hydrorefining of an asphaltene-containing black oil with hydrogen in contact with a colloidally dispersed vanadium catalyst in admixture with 2 weight percent to 30 weight percent water biased on the weight of the oil.

3 Claims, No Drawings

HYDROREFINING AN ASPHALTENE-CONTAINING BLACK OIL WITH UNSUPPORTED VANADIUM CATALYST

APPLICABILITY OF INVENTION

The invention described herein is adaptable to a process for the desulfurization of petroleum crude oil. More specifically, the present invention is directed toward a process for effecting a reduction in the sulfur content of atmospheric tower bottoms products, vacuum tower bottoms products, crude oil residuum, topped crude oils, the crude oils extracted from tar sands, all of which are sometimes referred to as "black oils," and which contain a significant quantity of asphaltenic material.

Petroleum crude oils, particularly heavy oils, extracted from tar sands, and topped or reduced crudes, contain high molecular weight sulfurous compounds in exceedingly large quantities. In addition, such crude, or black oils contain excessive quantities of nitrogenous compounds, high molecular weight organo-metallic complexes consisting principally of nickel and vanadium, and asphaltenic material. The latter is generally found to be complexed, or linked with sulfur and, to a certain extent, with the organo-metallic contaminants. The utilization of these highly contaminated black oils, as a source of more valuable liquid hydrocarbon products, is precluded unless the sulfur and asphaltene content is sharply reduced, and such a reduction is not easily achieved by preferred techniques involving fixed-bed catalytic processing.

The process encompassed by the present invention is particularly directed toward the catalytic desulfurization of petroleum crude oils utilizing a colloidally dispersed vanadium catalyst while simultaneously converting asphaltenic material. More specifically, the present invention is directed toward a process for hydrorefining petroleum crude oil and other heavy hydrocarbon charge stocks to effect the removal of nitrogen and sulfur therefrom, and affords unexpected advantages in effecting the destructive removal of organo-metallic contaminants and/or the conversion of pentane-insoluble hydrocarbonaceous material.

Petroleum crude oil, and the heavier hydrocarbon fractions and/or distillates obtained therefrom, particularly heavy vacuum gas oils and topped crudes, generally contain nitrogenous and sulfurous compounds in large quantities. In addition, petroleum crude oils contain detrimentally excessive quantities of organo-metallic contaminants which exert deleterious effects upon the catalyst utilized in various processes to which the crude oil, topped crude oil, or heavy hydrocarbon fraction thereof may be ultimately subjected. The more common of such metallic contaminants are nickel and vanadium, often existing in concentrations in excess of about 50 ppm, although other metals including iron, copper, etc., may be present. These metals may exist within the petroleum crude oil in a variety of forms: they may exist as metal oxides or as sulfides, introduced into the crude oil as a form of metallic scale; they may be present in the form of soluble salts of such metals; usually, however, they are present in the form of organo-metallic compounds such as metal porphyrins and various derivatives thereof. Although metallic contaminants, existing as oxide or sulfide scale, may be removed, at least in part, by a relatively simple filtering technique, and the water-soluble salts are at least in part removable by washing and a subsequent dehydration procedure, a much more severe treatment is required to effect the destructive removal of the organo-metallic compounds, particularly to the degree which is necessary to produce a crude oil or heavy hydrocarbon fraction suitable for further processing.

In addition to organo-metallic contaminants, including metal porphyrins, crude oils contain greater quantities of sulfurous and nitrogenous compounds than are generally found in lighter hydrocarbon fractions such as gasoline, kerosene, light gas oil, etc. For example, a Wyoming sour crude having a gravity of 23.2, ° API at 60° F., contains about 2.8% by weight of sulfur and approximately 2700 ppm of total nitrogen, 18 ppm of nickel and 81 ppm of vanadium calculated as the elements thereof. Upon being subjected to a catalytic hydrorefining process, the nitrogenous and sulfurous compounds are converted into hydrocarbons, ammonia and hydrogen sulfide. However, the reduction in the concentration of the organo-metallic contaminants is not easily achieved, and they remain to the extent that they exert a detrimental effect with respect to further processing of the crude oil. Notwithstanding that the total concentration of these metallic contaminants may be relatively small, for example, less than about 10 ppm of metal porphyrins, calculated as the elemental metals, subsequent processing techniques will be adversely affected thereby. Thus, when a hydrocarbon charge stock containing metals in excess of about 3 ppm, is subjected to a cracking process for the purpose of producing lower-boiling components, metals become deposited upon the catalyst employed, steadily increasing in quantity until such time as the composition of the catalytic composite is changed to the extent that undesirable results are obtained. That is to say, the composition of the cracking catalyst is closely controlled with respect to the nature of the charge stock being processed and to the desired product quality and quantity. This composition is changed considerably as a result of the deposition of the metallic contaminants thereupon, the changed composite inherently resulting in changed catalytic characteristics. Such an effect is undesirable since the deposition of metallic contaminants upon the catalyst results in a lesser quantity of valuable liquid hydrocarbon product, and in large amounts of hydrogen and coke, the latter also producing relatively rapid catalyst deactivation.

In addition to the foregoing described contaminating influences, crude oils and other heavier hydrocarbon fractions contain excessive quantities of pentane-insoluble material. For example, the Wyoming sour crude described above consists of about 8.3% by weight of pentane-insoluble resins and asphaltenes; these are hydrocarbonaceous componds considered to be coke precursors having the tendency to become immediately deposited within the reaction zone and onto the catalytic composite in the form of a high molecular weight, gummy residue. Since this constitutes a relatively large loss of charge stock, it is economically desirable to convert such resins and asphaltenes into useful hydrocarbon oil fractions, thereby increasing the liquid yield of desired product, based upon the quantity of oil charged to the process.

PRIOR ART

In U.S. Pat. No. 3,501,396, the patentee desulfurizes an asphaltene-containing black oil admixed with water utilizing a catalyst comprising nickel-molybdenum metals supported on an alumina-silica carrier material. The broadest teaching of metal components suitable for the process of U.S. Pat. No. 3,501,396 is metals selected from Group VI-B and VIII of the Periodic Table, as indicated in the Periodic Chart of the Elements, Fisher Scientific Co. (1953). Patentee further teaches the necessity of a catalyst support which provides a catalytic acid function, for example, silica.

The patentees in U.S. Pat. No. 3,252,895 have disclosed a process for hydrorefining crude oil utilizing a colloidally suspended vanadium catalyst.

The patentees in U.S. Pat. No. 3,303,126 have disclosed a process for hydrorefining crude oil in the presence of $H_2$ and $H_2S$.

The patents delineated hereinabove fail to teach a process for hydrorefining an asphaltene-containing black oil which comprises admixing black oil with water and reacting the resulting mixture with hydrogen in the presence of hydrogen sulfide and in contact with a colloidally dispersed vanadium catalyst.

OBJECTS AND EMBODIMENTS

The principal object of this invention is to provide an economically feasible catalytic crude oil desulfurization, demetallation and hydroconversion process in which the catalytic composite exhibits an unusually excellent degree of stability. The present process produces a crude oil product containing less than about 60 weight percent of the sulfur originally present in the crude oil, and simultaneously decreases the asphaltenic and metals content significantly.

Therefore in a broad embodiment, the present invention encompasses a process for hydrorefining an asphaltene-containing black oil which comprises admixing said black oil with from about 2 percent to about 20 percent by weight of water, and reacting the resulting mixture with hydrogen in contact with a colloidally dispersed vanadium catalyst at hydrorefining conditions.

A more specific embodiment relates to a process for hydrorefining an asphaltene-containing black oil which comprises admixing said black oil with from about 2 percent to about 20 percent by weight of water, and reacting the resulting mixture with hydrogen in contact with a colloidally dispersed vanadium catalyst at a temperature within the range of about 225° C. to about 500° C. and at a pressure of about 500 to about 5000 psig.

SUMMARY OF THE INVENTION

The term "hydrorefining" as employed herein, connotes the catalytic treatment, in an atmosphere of hydrogen, of a hydrocarbon fraction for the purpose of eliminating and/or reducing the concentrations of various contaminating influences such as metals, asphaltenes, sulfur and nitrogen. In a fixed bed process, metals are removed by the deposition of the metals onto the catalyst employed. This shields the catalytically active surfaces from the material being processed and thereby generally precludes the efficient utilization of a fixed-bed catalyst system for processing such contaminated oil. Various moving-bed processes, employing catalytically active metals deposited upon a carrier material consisting of silica and/or alumina, for example, or other refractory inorganic oxide material, are extremely erosive, causing plant maintenance to become difficult and expensive. The present invention utilizes a colloidally dispersed, unsupported catalytic material which will not cause extensive erosion or corrosion of the reaction system. The present process yields a liquid hydrocarbon product which is more suitable for further processing without experiencing the difficulties otherwise resulting from the presence of the foregoing contaminants. The process of the present invention is particularly advantageous for effecting the conversion of the organo-metallic contaminants without significant product yield loss, while simultaneously converting pentane-insoluble material into pentane-soluble liquid hydrocarbons.

A suitable unsupported vanadium catalyst is decomposed vanadyl acetylacetonate. Other organovanadium compounds may also be used as a vanadium catalyst or vanadium catalyst precursors. A preferred method for preparing the colloidal vanadium catalyst involves dissolving vanadyl acetylacetonate in an appropriate solvent such as an alcohol, ketone or ester containing up to and including about 10 carbon atoms per molecule. The solution is then added to the hydrocarbon feed stock and the mixture is heated at a temperature less than about 310° C. to remove the solvent and decompose the vanadyl acetylacetonate, thereby creating a colloidally dispersed catalyst suspended in hydrocarbon feed stock. The decomposition of the vanadium catalytic precursor, in this instance vanadyl acetylacetonate, is effected below a temperature of about 310° C. to prevent premature cracking of the hydrocarbon, particularly in the absence of hydrogen. The quantity of vanadyl acetylacetonate is such that the colloidal suspension or dispersion, resulting when the material is decomposed, comprises from about 1% to about 10% by weight, calculated, however, as elemental vanadium.

Typical of the alcohols suitable for use in preparing the solution of vanadyl acetylacetonate, include isopropyl alcohol, isopentyl alcohol, methyl alcohol, amyl alcohol, mixtures thereof, etc.

The resulting colloidal dispersion is then passed together with from about 2% to about 20% by weight of water into a suitable reaction zone maintained at a temperature within the range of from about 225° C. to about 500° C. and under a hydrogen pressure within the range of about 500 to about 5000 psig. The process may be conducted as a batch type procedure or in an enclosed vessel through which the colloidal suspension and water is passed. When the process is effected in a continuous manner, the process may be conducted in either upward flow or downward flow. The normally liquid hydrocarbons are separated from the total reaction zone effluent by any suitable means, for example, through the use of a centrifuge or settling tanks, at least a portion of the resulting catalyst-containing sludge being combined with the fresh hydrocarbon feed, and recycled to the reaction zone. In order to maintain the highest possible degree of activity, it is preferred that at least a portion of the catalyst containing sludge be removed from the process prior to combining the remainder with fresh hydrocarbon feed. The precise quantity of the catalyst containing a sludge removed from the process will be dependent upon the desired degree of catalytic activity. In hydrocarbon feed stocks containing relative high quantities of indigenous vanadium, new suspended vanadium catalyst is formed during the processing of the hydrocarbon feed in the reaction zone. In some cases this vanadium catalyst formation is sufficient to maintain an adequate supply of active catalyst for the process and in which case further addition of vanadium or vanadium precursors is not required. However, in other cases it may be desirable to add a quantity of fresh vanadium or vanadium precursors to the hydrocarbon charge in order to compensate for that quantity of vanadium removed from the process with the discarded sludge.

The colloidal dispersion of decomposed vanadyl acetylacetonate, or other organovanadium compound such as the vanadyl ester of isoamyl alcohol, the ester of t-butyl alcohol, etc., and the hydrocarbon feed stock is reacted with hydrogen under hydrocarbon conversion conditions, and preferably in the presence of hydrogen sulfide. The catalytic material is capable of hydrogenating and/or hydrocracking, the more easily reduced sulfur compounds within the crude oil, thereby producing hydrogen sulfide. However, when the reactions are initiated in the presence of added hydrogen sulfide, a more active catalyst is produced immediately and which catalyst is capable of the destructive removal of the less easily reduced hydrocarbon contaminants. The beneficial effects of the added hydrogen sulfide appear to occur only when the latter is present at the time the hydrogenation reactions are being initiated. The hydrogen sulfide is generally added to the hydrogen atmosphere in an amount of about 1 to about 15 mol percent.

I have discovered that if water is admixed with the hydrocarbon feed stock prior to the hydrogenation processing, the operating conditions for a given level of hydrocarbon conversion are significantly less severe than those currently deemed necessary. The presence of water in the process of my invention reduces the quantity of hydrogen sulfide which must be supplied to the prior art processes as well as reducing the amount of hydrogen circulation, and the reaction zone temperature and pressure. Although the hydrogenation process produces hydrogen sulfide, the maximization of the processes' advantages may require the presence of more hydrogen sulfide than can be internally generated. The production, storage and addition of external hydrogen sulfide is an onerous task and therefore, if the quantity of supplemental hydrogen sulfide is minimized, the advantages of a vanadium slurry catalyzed process are enhanced.

The following examples are given to further illustrate the process of the present invention and to indicate the benefits to be afforded through the utilization thereof. It is understood that these examples are given for the sole purpose of illustrating methods for the practice of the present invention and that the examples are not intended to limit the generally broad scope and spirit of the appended claims.

The crude oil employed in a Wyoming sour crude having a gravity of 23.2° API at 60° F., containing about 2.8% by weight of sulfur, approximately 2700 ppm of nitrogen, 18 ppm of nickel and 81 ppm of vanadium as metal porphyrins, computed as the elemental metals. In addition, the sour crude consisted of about 8.3% by weight of pentane-insoluble asphaltenes. As hereinafter indicated, the process of the present invention not only effects the conversion of a significant proportion of the pentane-insoluble asphaltenes, but also results in a substantial production of lower-boiling hydrocarbons as indicated by an increase in gravity of the normally liquid hydrocarbon portion of the total product effluent.

EXAMPLE I

Vanadyl acetylacetonate, in an amount of 42 grams, was added to 500 grams of normal and amyl alcohol, and heated over a steam bath to dissolve the vanadyl acetylacetonate. The solution was added to 250 grams of Wyoming sour crude, distilling off the amyl alcohol as the same was added. Upon complete addition, the temperature was raised to 180° C. for a period of 30 minutes, and 100 grams of the resulting mixture was placed in an autoclave and pressured to 100 atmospheres of hydrogen. After a period of 8 hours at a temperature of 400° C. and a resulting final pressure of 205 atmospheres, the normally liquid portion of the product effluent indicated a gravity of 38.5° API at 60° F., and was contaminated by the presence of 942 ppm nitrogen, 0.4 percent by weight sulfur, 0.64 weight percent pentane-insoluble asphaltenes, 0.1 ppm nickel and 63 ppm vanadium. This example illustrates the inadequacy of vanadyl acetylacetonate to function as a suitable hydrorefining catalyst when admixed with the petroleum crude oil and subjected to hydrorefining conditions in the absence of added hydrogen sulfide or water. Notwithstanding that there has been effected a partial cleanup of the crude oil, the same is obviously not suitable for further processing without additional hydrorefining pretreatment.

EXAMPLE II

Sufficient vanadyl acetylacetonate was added to 125 grams of the Wyoming sour crude in alcohol solution to result in a colloidal suspension containing 2.9 weight percent vanadium. The mixture was intimately admixed at a temperature of 250° C. for a period of 1 hour, cooled and then placed in the rocker-type autoclave, and initially pressured to 10 atmospheres with hydrogen sulfide then to 100 atmospheres with hydrogen. The autoclave was heated to a temperature of 400° C., resulting in a pressure of 201 atmospheres. After a period of 8 hours, the normally liquid portion of the total product effluent had a gravity of 37.5° API at 60° F., contained 61 ppm nitrogen, 0.01 weight percent sulfur, less than 0.03 ppm nickel and only 0.07 ppm vanadium, with no indication of the presence of pentane-insoluble asphaltenes. This example indicates the improved results when the vanadyl acetylacetonate is dispersed as an alcohol solution within the hydrocarbon oil, and hydrogen sulfide is added prior to initiating the hydrogenating-hydrocracking reactions. The utilization of the vanadyl acetylacetonate together with a high level of added hydrogen sulfide results in a liquid hydrocarbon product suitable for further processing. During the processing of the Wyoming sour crude with a colloidal suspension of approximately 3 weight percent vanadium in a continuous mode, as opposed to a batch operation, the inherent generation of hydrogen sulfide during sulfur removal from hydrocarbons will be insufficient to maximize catalytic activity, and therefore, additional hydrogen sulfide injection from an external source is highly desirable.

EXAMPLE III

Sufficient vanadyl acetylacetonate is added to 125 grams of Wyoming sour crude in alcohol solution to result in a colloidal suspension containing 2.9 weight percent vanadium. The mixture is intimately admixed at a temperature of 250° C. for a period of 1 hour, cooled and then placed in the rocker-type autoclave with 10 grams of water, and initially pressured to 5 atmospheres with hydrogen sulfide, then to 100 atmospheres with hydrogen. The pressured autoclave is heated to a temperature of 390° C., resulting in a pressure of approximately 200 atmospheres. After a period of 7 hours, the normally liquid portion of the total product effluent has a gravity of approximately 37° API at 60° F., contains approximately 60 ppm nitrogen, 0.01 weight percent sulfur, less than 0.03 ppm nickel and 0.07 ppm vanadium, with no indication of the presence of pentane-insoluble asphaltenes. This example illustrates that when the vanadyl acetylacetonate is dispersed as an alcohol solution within the hydrocarbon oil and water is present during the hydrogenating-hydrocracking reactions, the severity of the reaction conditions are reduced and the requirement for the injection of additional hydrogen sulfide is substantially reduced.

I claim as my invention:

1. A process for hydrorefining an asphaltene-containing black oil which comprises admixing said black oil with from about 2% to about 20% by weight of water, and reacting the resulting mixture with hydrogen in contact with a colloidally dispersed unsupported vanadium catalyst at hydrorefining conditions.

2. The process of claim 1 wherein said hydrorefining conditions include the addition of hydrogen sulfide to the reaction.

3. The process of claim 1 wherein the reaction conditions include a temperature from about 225° C. to about 500° C. and a hydrogen pressure from about 500 to about 5000 psig.

* * * * *